US007234245B2

(12) United States Patent
Tatum

(10) Patent No.: US 7,234,245 B2
(45) Date of Patent: Jun. 26, 2007

(54) ATTACHMENT APPARATUS AND METHODS

(76) Inventor: Donald Curtis Tatum, 5610 Azalea, Beaumont, TX (US) 77707

( * ) Notice: Subject to any disclaimer, the term of this patent is extended or adjusted under 35 U.S.C. 154(b) by 0 days.

(21) Appl. No.: 11/247,797

(22) Filed: Oct. 11, 2005

(65) Prior Publication Data

US 2006/0075650 A1 Apr. 13, 2006

Related U.S. Application Data

(60) Provisional application No. 60/618,494, filed on Oct. 13, 2004.

(51) Int. Cl.
*B25H 7/00* (2006.01)

(52) U.S. Cl. ..... 33/666; 33/613

(58) Field of Classification Search ..... 33/666, 33/613, 577

See application file for complete search history.

(56) References Cited

U.S. PATENT DOCUMENTS

| | | | | |
|---|---|---|---|---|
| 3,516,165 | A | 6/1970 | Pfeffer | |
| 4,382,337 | A * | 5/1983 | Bendick | 33/574 |
| 4,753,014 | A | 6/1988 | Vrajich | |
| 5,398,906 | A | 3/1995 | Aydelott | |
| 5,471,760 | A | 12/1995 | Farris | |
| 5,509,213 | A | 4/1996 | Kelly et al. | |
| 5,867,917 | A | 2/1999 | Karon | |
| 6,000,142 | A | 12/1999 | Deaton | |
| 6,032,378 | A | 3/2000 | Null | |
| 6,185,831 | B1 | 2/2001 | Pluciennik | |
| 6,286,803 | B1 | 9/2001 | Pellino et al. | |
| 6,574,880 | B2 * | 6/2003 | Lombardo | 33/666 |
| 6,666,425 | B1 | 12/2003 | Ferguson | |
| 6,739,065 | B2 | 5/2004 | Hofmeister et al. | |
| 6,952,887 | B2 * | 10/2005 | Muchnik | 33/666 |
| 6,957,797 | B1 | 10/2005 | Strobel | |
| 2003/0014872 | A1 | 1/2003 | Chen | |
| 2004/0098875 | A1 * | 5/2004 | Gould | 33/613 |
| 2004/0177527 | A1 | 9/2004 | Prevost | |
| 2006/0096111 | A1 * | 5/2006 | Dolenz et al. | 33/613 |

* cited by examiner

*Primary Examiner*—Christopher W. Fulton
(74) *Attorney, Agent, or Firm*—Jeffrey L. Wendt

(57) ABSTRACT

Apparatus and methods for precisely locating and marking where to fasten an object, such as a plaque or photograph, on a surface, such as a wall are described. The apparatus comprises a fastening means, a main body, the main body having a first surface contacting the fastening means, and a second surface, an indicator, the indicator having a shaft extending from the second surface of the main body and ending in a distal end comprising a means for marking, and a compressible material encapsulating the indicator. The marking means may be a sharp point of metal or plastic, and may include a marking composition, such as ink, chalk, glue, and the like. This abstract allows a searcher or other reader to quickly ascertain the subject matter of the disclosure. It will not be used to interpret or limit the scope or meaning of the claims.

20 Claims, 2 Drawing Sheets

ATTACHMENT APPARATUS AND METHODS

CROSS-REFERENCE TO RELATED APPLICATIONS

This application claims priority under 35 U.S.C. 119(e) from U.S. provisional patent application Ser. No. 60/618,494, filed Oct. 13, 2004, which is incorporated herein by reference in its entirety.

BACKGROUND OF THE INVENTION

1. Field of the Invention

The invention is generally related to the field of attachment or fastening mechanisms. More specifically, the invention relates to apparatus and methods for reducing or eliminating the guesswork in placing a framed photograph, shelf bracket, or other object on a wall precisely where it is desired to be placed, in a simple and inexpensive manner.

2. Related Art

Photographs, awards, memorabilia, valuable artifacts and many other items have attained special place in our daily lives as reminders of friends and relatives, a source of pride and achievement, a means of relieving stress through play, and in some cases a means of adding to our income through trading, such as signed photographs of famous individuals. When it is desired to display such items, either commercially or for personal enjoyment, it is frequently necessary to place the item directly on a wall (in case of a framed photograph or award plaque), on a shelving unit which is in turn attached to a wall, or on some other surface. This presents an age old problem: positioning the item or shelving unit precisely where it is desired, without the need for multiple holes, gouges, scratches, and marks in or on the wall or other surface. In today's world, where space and time come at a premium, and costs for displaying and/or preserving items for future viewing can be onerous, not to mention the expense of repairing unsightly marks, there is a great desire to quickly and inexpensively position the mounting mechanism precisely where it is desired, without unnecessarily damaging the underlying surface.

There are of course many known devices in the patent literature for accurately positioning items on a wall or other surface, however, these devices are either very different from the methods and apparatus proposed herein, much more expensive, more complicated, or all of these.

There may be found, for example, U.S. Pat. No. 5,398,906, which discloses a device for marking a wall to indicate where to install a support element such as a nail for hanging an article such as a picture. The device is self-supporting in relation to the article and is releasably attachable to the suspension element on the article. A preferred embodiment is attachable to a saw-tooth type bracket suspension element. A second embodiment of the wall-marking device is attachable to pictures equipped with wire or cord for hanging. A third embodiment is usable with either saw-tooth type bracket or wire suspension elements. U.S. Pat. No. 5,509,213 discloses a complex picture hanger aligning device and method for locating and aligning one or more picture hangers on a wall. An elongated, vertical center member and an elongated horizontal member having hooks protruding outwardly therefrom are connected in a triangular fashion by two elongated side members. A picture is hung from hooks on the horizontal member or, alternatively, from a hook on the vertical member, and held in a desired position against a wall. The position of a scribe hole in the vertical member is marked by inserting a marking utensil through the scribe hole, the picture is removed from the device, and the device is held against the wall in the desired position by aligning the scribe hole with the corresponding mark on the wall. The position of the hooks from which the picture is hung is then marked on the wall by inserting a writing utensil through scribe holes associated with the hooks. Hangers can then be inserted in the wall at the aligned positions of the wall marks, resulting in aligned picture hangers from which the picture can be hung. U.S. Pat. No. 5,867,917 discloses picture hanger locating device for use with a picture having a hanging cord positioned on the rear thereof intended to be disposed over a hook or like member to be secured to a wall behind the desired location of the picture. A wall marking device is employed to mark the wall at the location along the length of the cord where the hook member should be placed to engage the cord when the picture is hung on the wall. U.S. Pat. No. 6,666,425 discloses a complicated vertically adjustable wall hanger. U.S. Pat. No. 6,739,065 discloses a device for use in marking a point on a wall where a fastener should be installed in order to hang an object at a desired location on the wall. The device includes an elongate frame having an elongate slot, the frame adapted to be positioned adjacent to a back surface of the object to be hung. The device further includes a ledge projecting from the frame adapted to be positioned in contact with a top surface of the object. The device also includes a carriage that is supported by the frame, the carriage adapted for reciprocating movement along the slot. The device further includes a pin that is carried by the carriage. A recently published patent application, U.S. Pat. Pub. No. 20030014872A1, published Jan. 23, 2003 describes a pocket-sized picture hanger for use in building construction and interior decoration to locate and mark a desired position, mainly includes a base provided with leveling means, and a cover pivotally connected to a top of the base and provided with a light beam projecting means for selectively projecting horizontal or vertical linear beams. The base could be adjusted to a completely horizontal position by adjusting the leveling means, so as to ascertain the levelness or perpendicularity of light beams projected from the light beam projecting means.

As may be seen, the need remains for simple methods and apparatus to efficiently, quickly, inexpensively, and safely position framed photos, award plaques, shelving units, and other devices on a wall or other surface.

SUMMARY OF THE INVENTION

In accordance with the present invention, apparatus are presented which reduce or overcome the problems of previously known devices.

A first embodiment of the apparatus comprises:

a) a fastening means;

b) a main body, the main body having a first surface contacting the fastening means, and a second surface;

c) an indicator, the indicator having a shaft extending from the second surface of the main body and ending in a distal end comprising a means for marking; and d) a compressible material enclosing the indicator.

Preferred apparatus of the invention are those wherein the fastening means is selected from the group consisting of adhesives, one portion of a hook and loop fastener, and suction means. The adhesive may be a double-sided adhesive tape having first and second adhesive surfaces, the first adhesive surface contacting the first surface of the main body. Alternatively, the adhesive may be a thin layer of adhesive coated on the first surface of the main body. In either case the adhesive may be selected from the group consisting of pressure-sensitive adhesives, temperature-sensitive adhesives, and hot-melt adhesives, and the like. The main body and indicator may be comprised of the same or different sufficiently rigid natural or synthetic material, such as leather, wood, metal, stone, ceramic or plastic. When the indicator is metal the marking means is preferably a point on the distal end of the shaft of the indicator. The indicator may be a wire embedded at one end in the main body, the end distal form the main body being the marking means. The indicator may be a tack adhered to the main body. The marking means may be a point which makes a physical indentation in the surface, a composition which visually marks (without indenting) the surface, or an element that combines physical indentation and visual marking. Visual, non-denting markers comprise a marking composition selected from the group consisting of ink, paint, glue, wax, chalk and the like. The marking composition may include luminescent, phosphorescent, and/or light reflective materials. The compressible material may be a natural material, including, but not limited to, leather, or synthetic material such as woven and nonwoven materials and foams. Suitable woven and nonwoven synthetic materials include those comprising fibers selected from the group consisting of polyamide, polyester, and combinations thereof. Useable foamed materials include synthetic foam materials, preferably closed cell foams, wherein the synthetic foam material is selected from the group consisting of foamed polystyrene, foamed polyurethane, and foamed polyethylene.

A second aspect of the invention are methods of precisely locating and marking a point on a surface where an object is to be fastened, a preferred method comprising the steps of:

a) positioning an apparatus of claim 1 at the desired point with the compressible material touching the surface; and b) exerting force on the apparatus sufficient to compress the compressible material and mark the point with the marking means.

Further aspects and advantages of the invention will become apparent by reviewing the description of preferred embodiments that follows.

DESCRIPTION OF PREFERRED EMBODIMENTS

The present invention relates generally to inexpensive and simple to use apparatus and methods for locating the precise position where an article is to be placed on a surface. A particular use for apparatus of the invention is for locating the precise position to hang a framed article on a wall, although the articles are not limited to framed articles, nor is the surface limited to walls.

Figure 1:
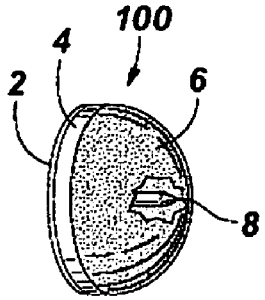
FIG. 1 is a perspective view, with a portion broken away, of a first embodiment of the apparatus of the invention.
Figure 1A:
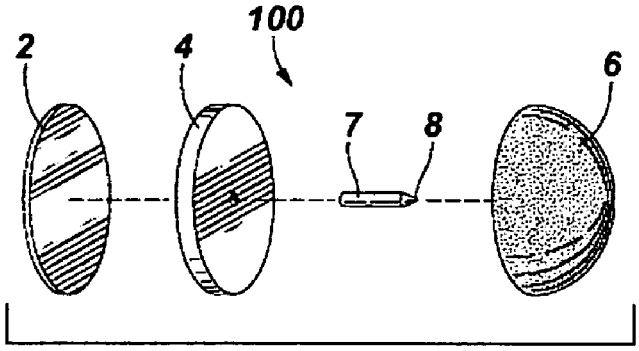
FIG. 1A is an exploded perspective view of the apparatus of FIG. 1.

Referring to FIGS. 1 and 1A, there is illustrated schematically, with parts broken away, a perspective view and an exploded perspective view, respectively of one apparatus 100 in accordance with the invention. This apparatus comprises a double-sided adhesive tape 2, a sufficiently rigid main body 4, and a compressible material 6 adhered to main body 4, for example by glue, or simply by means of mechanical friction contact with an indicator means 7, 8, which in this embodiment is simply a metal shaft 7 having a distal tip 8. The indicator may simply be a metal wire, having one end driven into main body 4. Compressible material 6 encloses indicator, 7, 8, until it is desired to mark the surface. When marking a surface is desired, the compressible material compresses to reveal the distal tip or point, 8, which indents the wall or other surface.

Figure 2:
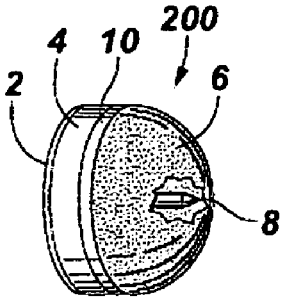
FIG. 2 is perspective view, with a portion broken away, of a second embodiment of the apparatus of the invention.
Figure 2A:
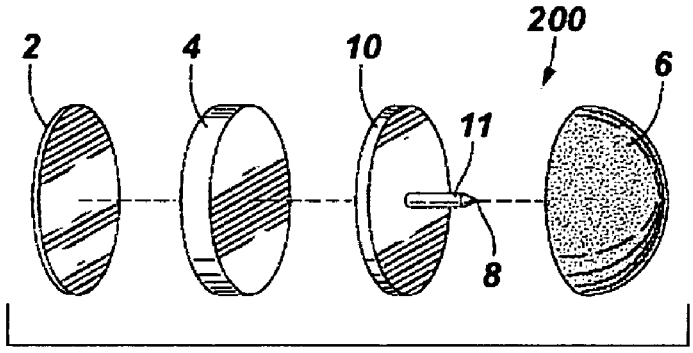
FIG. 2A is an exploded perspective view of the apparatus of FIG. 2.

FIGS. 2 and 2B illustrate schematically another embodiment 200, again with parts broken away, similar to embodiment 100 of FIG. 1A, but differing in architecture by employing a common carpet tack 10 having a shaft 11 and distal tip 8. Tack 10 is glued or otherwise fastened to main body 4 in known fashion. If main body and tack were both metallic they could be formed from a single piece of metal. It is not necessary for main body and tack 10 to be comprised of similar materials.

Figure 3:
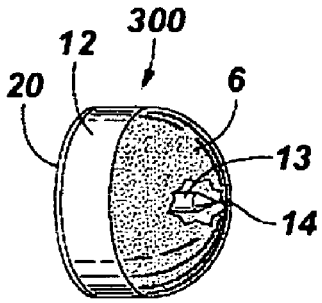
FIG. 3 is a perspective view, with a portion broken away, of a third embodiment of the apparatus of the invention.
Figure 3A:
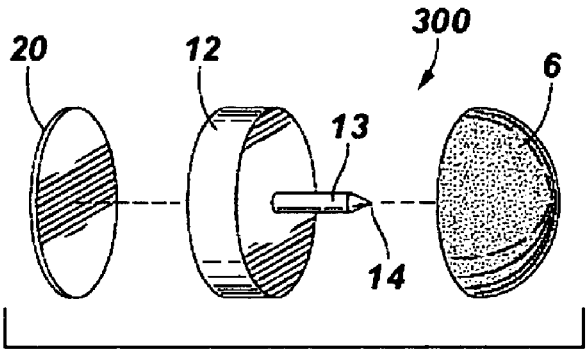
FIG. 3A is an exploded perspective view of the apparatus of FIG. 2.

FIGS. 3 and 3B illustrate schematically a third embodiment 300, again with parts broken away, similar to embodiments 100 and 200, but differing in architecture by having a thin film of adhesive 20 coated onto main body 12, which in this embodiment comprises a plastic material having an integral indicator shaft 13 and distal point 14 extending away from main body 12. Main body 12 and indicator 13 are preferably comprised of a single piece of injection molded plastic, polyamide plastic for example.

Figure 4:
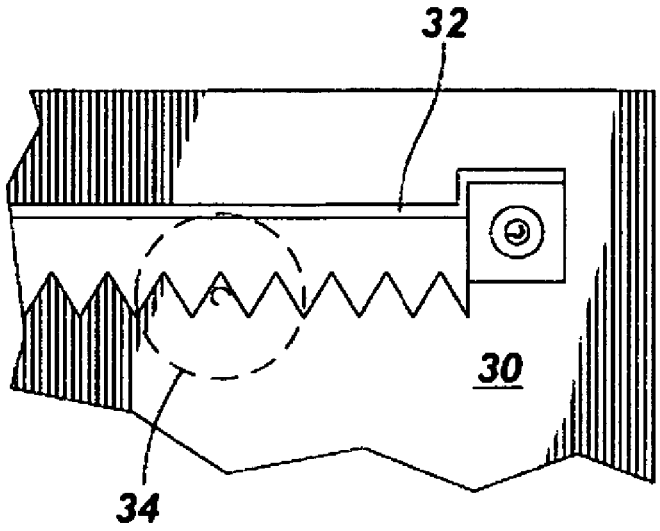
FIG. 4 is a plan view of an apparatus of the invention attached to an alligator mounting.

FIG. 4 illustrates in plan view, with parts in phantom, of a back side of a framed article 30 having a saw-toothed or gator hook mounting 32. Phantom circle 34 illustrates precisely where an apparatus of the invention would be placed on article 30, with fastening means touching the gator hook. The compressible material and indicator would be facing outward in the Z direction.

Figure 5:
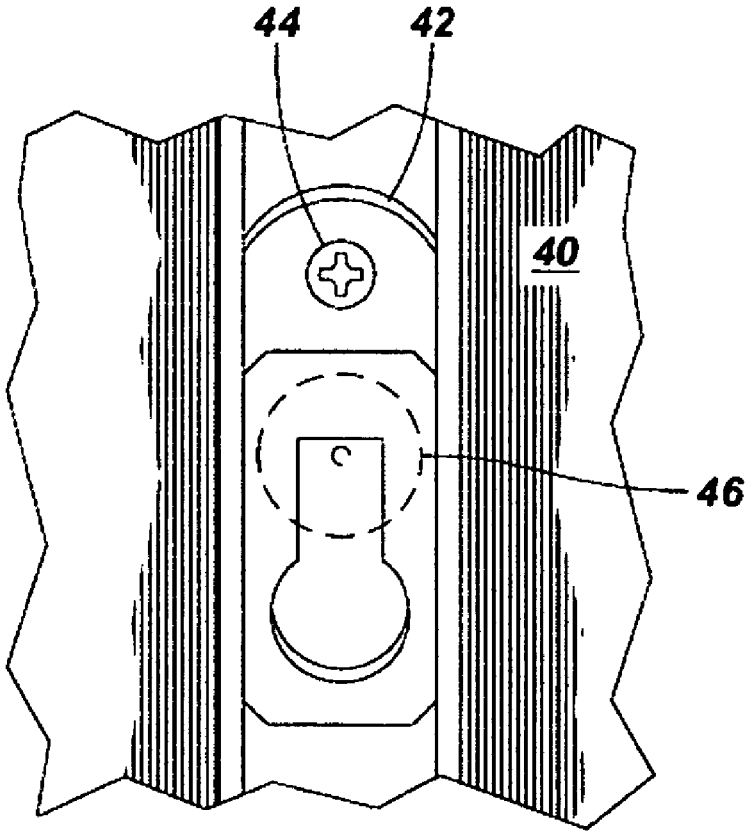
FIG. 5 is a plan view of an apparatus of the invention attached to a corbel mounting.

FIG. 5 illustrates a plan view of a framed article 40 having a corbel mounting 42 attached to the frame by a screw 44. Phantom circle 46 indicates where the apparatus of the invention would be placed, with the fastening side touching the corbel mounting, with compressible material and indicator directed outward n the Z direction.

Compressible materials suitable for use in the invention of course require the property of being compressible, and preferably spring back to their original shape when applied force is removed. Preferably the compressible material is made of a foamed polymeric material, such as foamed polystyrene, foamed polyurethane, foamed polyisocyanurate, foamed polyethylene, foamed rubbers, such as foamed polyvinyl chloride/acrylonitrile butadiene (PVC/NBR) rubber, and the like. Preferably the foam is a closed cell foam. Commercial products, such as the materials known under the trade designations "Ensolite®" and "OleTex®", both available from RBX Industries, Inc., Roanoke, Va., USA, may find use as compressible materials. Products known under the trade designation "Ensolite®" are made in many varieties, but are all essentially variations of PVC/NBR foamed polymers having maximum water absorption of 0.1 $lb/ft^2$ when tested using American Society of Testing Materials (ASTM) test D-1667. The products under the OleTex® product line are high-performance, closed cell polyolefin foams, chemically cross-linked using a patented, continuous processing method. The materials are closed cell and moisture proof. These products can be die cut, heat sealed, vacuum formed, and heat molded.

Main body and indicator materials may be natural, synthetic, or combination thereof. Polyamide injection molded materials are one preferred synthetic main body material, due to its strength and flexibility. A preferred natural material might be stone or bone. The material of choice will depend on many factors, including the desired weight, strength, and cost of manufacturing the apparatus. Injection molded plastic would seem to be the least expensive method of volume manufacturing the main body, with or without an integral indicator. Plastics may include one or more fillers to adjust mechanical properties.

Fastening means are common and require little explanation to the skilled artisan. One preferred hook and loop fastener is that known under the trade designation Velcro®, available from Velcro USA, Manchester, N.H. Adhesives useful in the invention include pressure-sensitive, temperature-sensitive, and melt-bonded adhesives. Double-sided adhesive tapes are known in the fastening art. Thin adhesive coatings are known, as are methods of applying thin adhesive coatings to surfaces. The adhesive coating need only be thick enough to ensure the apparatus performs its intended function once, but may be thick and tacky as necessary for multiple uses of the apparatus, if desired. A release liner is typically included on the adhesive, the liner being removed when the apparatus is ready to be used. Finally, the adhesive may be applied to the main body just before use, such as from a tube, and in this case the inventive apparatus may be packaged as a kit including a tube of adhesive.

The embodiments of the invention allow an owner of items the flexibility to display them inexpensively, without worrying about the expense of unnecessarily marking up the wall or other surface and fixing the unsightly marks. Further, in comparison to other devices and methods, the apparatus of the invention are relatively simple in design, yet effective, and may be used by homeowner and construction worker alike.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising:

a) a fastening means;

b) a main body, the main body having a first surface contacting the fastening means, and a second surface;

c) an indicator, the indicator having a shaft extending from the second surface of the main body and ending in a distal end comprising a means for marking;

d) a compressible material enclosing the indicator.

2. The apparatus of claim 1 wherein the fastening means is selected from the group consisting of adhesives, one portion of a hook and loop fastener, and suction means.

3. The apparatus of claim 2 wherein the adhesive is a double-sided adhesive tape having first and second adhesive surfaces, the first adhesive surface contacting the first surface of the main body.

4. The apparatus of claim 2 wherein the adhesive is a thin layer of adhesive coated on the first surface of the main body.

5. The apparatus of claim 2 wherein the adhesive is selected from the group consisting of pressure-sensitive adhesives, temperature-sensitive adhesives, and hot-melt adhesives.

6. The apparatus of claim 1 wherein the main body is comprised of wood.

7. The apparatus of claim 1 wherein the main body is comprised of plastic.

8. The apparatus of claim 1 wherein the main body is comprised of metal.

9. The apparatus of claim 1 wherein the indicator is metal and the marking means is a point on the distal end of the shaft.

10. The apparatus of claim 9 wherein the indicator is a tack adhered to the main body.

11. The apparatus of claim 1 wherein the marking means comprises a marking composition selected from the group consisting of ink, paint, glue and chalk.

12. The apparatus of claim 11 wherein the marking composition comprises a luminescent material.

13. The apparatus of claim 11 wherein the marking composition comprises a light reflective material.

14. The apparatus of claim 11 wherein the marking composition comprises a phosphorescent material.

15. The apparatus of claim 1 wherein the compressible material is a synthetic foam material selected from the group consisting of foamed polystyrene, foamed polyurethane, foamed polyolefin, and a foamed mixture comprising polyvinyl chloride and acrylonitrile butadiene rubber.

16. An apparatus comprising:

a) a fastening means;

b) a main body, the main body having a first surface contacting the fastening means, a second surface, and an indicator, the indicator having a shaft extending from the second surface of the main body and ending in a distal marking end; and c) a compressible material enclosing the indicator.

17. The apparatus of claim 16 wherein the fastening means is selected from the group consisting of adhesives, one portion of a hook and loop fastener, and suction means.

18. The apparatus of claim 16 wherein the main body is comprised of wood.

19. A method of precisely locating and marking a point on a surface where an object is to be fastened, the method comprising the steps of:

a) positioning an indicator of an apparatus at the desired point, the apparatus comprising i) a fastening means;

ii) a main body, the main body having a first surface contacting the fastening means, and a second surface;

iii) the indicator, the indicator having a shaft extending from the second surface of the main body and ending in a distal end comprising a means for marking; and iv) a compressible material enclosing the indicator; and b) with the compressible material touching the surface, exerting force on the apparatus sufficient to compress the compressible material and mark the point with the means for marking.

20. The method of claim 19 comprising adhering the apparatus via the fastening means to an object to be fastened to the surface prior to step (a).

* * * * *